United States Patent [19]

Kamo et al.

[11] 4,279,660

[45] Jul. 21, 1981

[54] PROCESS FOR THE RECOVERY AND REUTILIZATION OF THE USED MATERIALS IN EXISTING ASPHALT PAVEMENTS

[76] Inventors: Izumi Kamo, Tamaresidence No. 305, 1-2-7, Kitadenen, Fussa City, Tokyo; Tetsushi Okahara, 4-26-14, Minamitanaka, Nerima-ku, Tokyo, both of Japan

[21] Appl. No.: 134,256

[22] Filed: Mar. 26, 1980

[30] Foreign Application Priority Data

Sep. 6, 1979 [JP] Japan ..... 54-114427

[51] Int. Cl.[3] ..... C08L 95/00

[52] U.S. Cl. ..... 106/281 R; 208/39; 208/45

[58] Field of Search ..... 106/281 R, 280, 283, 106/285; 208/39, 45; 404/80

[56] References Cited

U.S. PATENT DOCUMENTS

| | | | |
|---|---|---|---|
| 3,668,110 | 6/1972 | Shea et al. | 208/45 |
| 4,000,000 | 12/1976 | Mendenhall | 106/281 R |
| 4,125,459 | 11/1978 | Garwin | 208/45 |
| 4,177,080 | 12/1979 | Mendenhall | 106/281 R |

*Primary Examiner*—Lorenzo B. Hayes
*Assistant Examiner*—Amelia B. Yarbrough
*Attorney, Agent, or Firm*—Jordan and Hamburg

[57] ABSTRACT

A process for the recovery and reutilization of materials in existing asphalt pavements includes comminuting existing asphalt pavement, subjecting the comminuted pieces to the action of a solvent is a dissolving zone to separate asphalt from other component materials, recovering solvent and asphalt dissolved therein from such zone separately from the other materials, drying and classifying the other material according to size, separating asphalt from the solvent, and transferring separated asphalt and the size-classified other materials to storage zones for subsequent reuse in the preparation of asphalt pavement.

9 Claims, No Drawings

PROCESS FOR THE RECOVERY AND REUTILIZATION OF THE USED MATERIALS IN EXISTING ASPHALT PAVEMENTS

BACKGROUND OF THE INVENTION

In view of the present conditions of road pavements, large quantities of the used materials in such asphalt pavements will become an environmental problem as the need arises for suitable dumping grounds therefor.

Despite the above circumstance established technology has not yet been developed. According to the conventional process, the used materials are first crushed and then cut back materials or asphalt materials are added thereto under mixture at room temperature. Alternatively the used materials are crushed into fractions to classify the grades and then asphalt is added thereto after hot drying to use same as an asphalt mixture.

However, it is to be noted that the reproduced asphalt mixture may only be used for roads which carry light weight vehicles because of its simple and easy reproduction thereof. Furthermore, there is still need to develop a drying apparatus for drying the crushed materials and also for drying the asphalt adhered to crushed stones etc. without causing combustion of said asphalt.

SUMMARY OF THE INVENTION

The present invention is mainly concerned with the recovery and reuse of the materials in existing asphalt pavements and aims to overcome the drawbacks of the conventional processes for reuse of such materials through a process in which the used materials can be employed as new materials in the preparation of new asphalt pavements.

In order to attain the above-mentioned object, the used materials of existing asphalt pavements are completely separated into asphalt and other component materials such as crushed stones, sands, powdered stones etc. by using a solvent to reproduce and utilize same as the new materials of new asphalt pavements.

For the above-mentioned purpose, the present invention provides a process for reconstitution of the used materials of existing asphalt pavements to provide almost new materials to be used in the construction of new asphalt pavements since such used materials are separated and restored to the condition before their actual use as materials for asphalt pavements also the storage and quality control of materials to be used for new asphalt pavements becomes easier.

DETAILED DESCRIPTION OF THE INVENTION

The present invention relates to a process for the reutilization of used materials in existing asphalt pavements.

The used materials in existing asphalt pavements are stripped from existing asphalt pavements during the improvement and repair thereof, and such used materials which have thus been stripped out have conventionally been discarded on filled-in land and in other dumping grounds.

Judging from the actual present conditions of road pavements large quantities of the used materials of asphalt pavements will have to be disposed of in the future. Accordingly, disposition of the used material will cause environmental problems which requires an adequate solution.

In the above-mentioned circumstances, it has been considered desirable to develop a technology which not only recovers and reconstitutes the component materials of existing asphalt pavements, to solve the above-mentioned environmental problems, but which also contributes to a saving of in material resources. As regards the development of a technology in respect of the reutilization and reproduction of the used material, it has been desired to develop same relative to integration in the following sequence: (1) stripping off the existing asphalt pavement (2) crushing (3) fractionation (4) storage (5) reproduction and manufacturing (6) transportation and preparation of the new pavement. However, no established technology has been developed at present. According to the current technology (a) the used materials from an asphalt pavement are first crushed and then the cut back materials or asphalt materials are mixed therewith at room temperature, or (b) the used materials are crushed into fractions and are classified by grades and then asphalt is added thereto after heat drying to use same as an asphalt mixture.

In other words, the above-mentioned process consists of the under-mentioned process, (a) the used materials of an asphalt pavement→crushing→mixing at room temperature→to obtain a reproduced asphalt mixture or; (b) the used materials of an asphalt pavement→crushing → mixing by heating→ to obtain a reproduced asphalt mixture.

According to the above-mentioned conventional process, the reproduced asphalt mixture may only be used for roads which carry a light weight vehicle because of a simple and easy reproduction thereof in respect of the process indicated as (a) above; and, on the other hand, the hot air drying equipment for drying the crushed materials and the other drying equipment for drying the asphalts which adhere to the used materials without causing any combustion of the asphalt have to be developed.

The present invention is mainly concerned with the reproduction of the used materials in connection with the above-mentioned technical development indicated as item (5), and aims to overcome the drawbacks of the above-mentioned conventional process for reproduction of the used materials by recovering and reconstituting such materials for utilization as new materials.

In order to attain the above-mentioned object, according to the process of the present invention, the used materials in existing asphalt pavements are completely separated into asphalt and other component materials (crushed stones, sands, powdered stones etc.) by using a solvent to reproduce and utilize same as the new materials of a new asphalt pavement.

The present invention will now be explained in more detail in accordance with embodiments thereof.

As illustrated in the under-mentioned Table showing the process for separation and collection of the used materials of existing asphalt pavements, such used materials are cooled to a temperature ranging from −30° C. to −40° C. by means of a cooling apparatus and then are crushed into small pieces by using a disintegrator; and thereafter the small pieces are dissolved in a dissolving tank. Distillable solvents are used for this purpose. Furthermore, solvents with low viscosity are preferable and a boiling point of around 100° C. is suitable therefor. As an Example, according to the process for the present invention, dichloro propane is used as a solvent. The used materials are separated into asphalt and other component materials such as crushed stones, sands, powdered stones etc. in the dissolving tank. The viscosity of the used materials is considerably lowered owing to the solvent; and, as a result, even sands or powdered stones with a grist diameter ranging from 0.075 mm to 0.001 mm may be separated and collected. The miscellaneous material in the liquid mixed with asphalt and the solvent from which the crushed stones, sands, powdered stones etc. contained in the used materials have respectively been removed, are then filtrated through a filter; and thereafter the remaining liquid is transferred to a distillation apparatus for distillative separation. The boiling point of the solvent is around 100° C. which is comparatively low so that the heat necessary for distillation is small so as to minimize the reproduction cost. The asphalt which has been separated by distillation may be collected almost in a state of pure asphalt and is deposited in an asphalt deposit or storage tank. The solvent is separately deposited in a solvent deposit tank. In this case, the solvent thus separately deposited may be returned to the dissolving tank for reuse. Other materials such as crushed stones, sands, powdered stones etc. separated and collected from the dissolving tank are transferred to a drying apparatus for heat air drying. In this process, the solvent adhered to the above-mentioned materials is collected and transferred to the above-mentioned solvent deposit or storage tank by means of a solvent suction apparatus for its future use without any waste thereof. The other materials such as crushed stones, sands, powdered stones etc. from which the solvent has been removed are screen filtered to have a desired grist size. The above-mentioned other materials with a grist diameter of 20 mm and more, or the materials which have been incompletely dissolved, are further screen filtered to separate same and will be completely separated again by means of a disintegrator through the above-mentioned process.

Table showing the process for division and collection of the used materials from asphalt pavements:

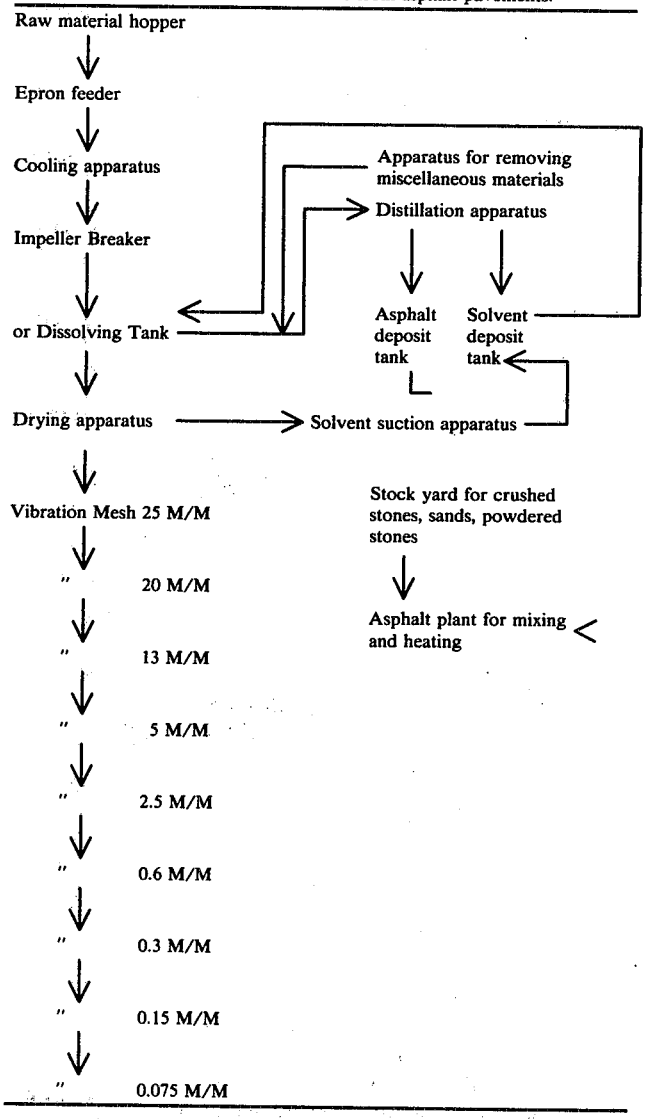

The grist size of the crushed stones, sands, powdered stones etc. to be mixed with asphalt is prescribed to be the size ranging from 20 mm to 0.074 mm (Asphalt Pavement Standard-Japan Roads Association-) and is classified through a screen mesh. According to each rank of a classified grist size, the amount in the mixture may be adjusted. For example, the size of 20 mm is adjusted to be 20%, 20–10 mm to be 30%, 10–5 mm to be 20%, 5 mm and less to be 30%, etc. According to the process of the present invention, since all of the used material may be separately collected, it is possible to classify a grist size by screening after separation and it may thus be used as the other material such as crushed stones, sands, powdered stones etc. of asphalt pavements with a prescribed strength. Accordingly, the process according to the present invention is quite different from the conventional process in which the used materials, crushed to a condition of incomplete separation, are mixed with another new asphalt; the asphalt and the other materials concerned respectively obtained from the used materials of an existing asphalt pavement may be used according to the present invention as material with almost new quality. Furthermore, as regards the above-mentioned technical steps identified as item (4) storage and item (6) transportation, these may automatically be decided upon depending upon the process concerned. It can be particularly mentioned that there is no fear of not being able to reuse the classified grists owing to readhesion during the recovery thereof. Accordingly, the process for the present invention may provide almost new materials to be used for asphalt pavements for the reasons that the used materials are separated and are available in the desired condition just before their actual reuse as material for new asphalt pavements. The storage and quality control of the material to be used for new asphalt pavements thus becomes easier.

What is claimed is:

1. A process for the recovery and reutilization of materials in existing asphalt pavements, comprising comminuting existing asphalt pavement, subjecting the comminuted pieces to the action of a solvent in a dissolving zone to separate asphalt from other component materials, recovering solvent and asphalt dissolved therein from said zone separately from said other materials, drying and classifying said other material according to size, separating asphalt from the solvent, and transferring separated asphalt and the size-classified other materials to storage zones for subsequent reuse in the preparation of asphalt pavement.

2. A process according to claim 1, wherein said existing asphalt pavement, prior to comminution, is cooled to a temperature of from −30° C. to −40° C.

3. A process according to claim 1, wherein said solvent and asphalt dissolved therein are subjected to distillation for separation and recovery.

4. A process according to claim 3, wherein at least a portion of the solvent recovered from distillation is recycled to said dissolving zone for contact with comminuted asphalt pavement.

5. A process according to claim 1, wherein said other materials comprise crushed stone, sand and powdered stone, said other materials being classified into a range of sizes of from approximately 20 mm. to 0.074 mm. by being screen filtered on a series of vibrating screens.

6. A process according to claim 1, wherein said solvent is a hydrocarbon having a boiling point of approximately 100° C.

7. A process according to claim 6, wherein said solvent is dichloropropane.

8. A process according to claim 1, wherein solvent is recovered from said drying step by means of suction apparatus.

9. A process according to claim 8, including recycling solvent recovered from said drying step to said dissolving zone for contact with comminuted asphalt pavement.

* * * * *